US005839573A

United States Patent [19]

Morini

[11] Patent Number: 5,839,573

[45] Date of Patent: Nov. 24, 1998

[54] ASSEMBLY FOR KEEPING SUBSTANCES OF A MIXTURE SEPARATE UNTIL USE

[75] Inventor: Emilio Morini, Colorno, Italy

[73] Assignee: Bormioli Rocco & Figlio S.p.A., Parma, Italy

[21] Appl. No.: 980,294

[22] Filed: Nov. 28, 1997

[30] Foreign Application Priority Data

Sep. 22, 1995 [IT] Italy ..... MO95 A 000128

[51] Int. Cl.[6] ..... B65D 81/32

[52] U.S. Cl. ..... 206/221; 215/DIG. 8

[58] Field of Search ..... 206/219–222, 206/568; 215/DIG. 8

[56] References Cited

U.S. PATENT DOCUMENTS

| | | | |
|---|---|---|---|
| 2,524,607 | 10/1950 | Smith | 206/221 |
| 3,347,410 | 10/1967 | Schwartzman | 206/222 |
| 3,441,179 | 4/1969 | Ragan . | |
| 5,542,528 | 8/1996 | Lanfranconi et al. | 206/221 |

FOREIGN PATENT DOCUMENTS

| | | |
|---|---|---|
| 0 366 534 | 5/1990 | European Pat. Off. . |
| 0 634 340 | 1/1995 | European Pat. Off. . |
| 1 054 170 | 9/1955 | France . |

*Primary Examiner*—Jim Foster
*Attorney, Agent, or Firm*—Browdy and Neimark

[57] ABSTRACT

The assembly for keeping different substances separate up to the moment of use comprises a container (1) on which is inserted a deformable and internally hollow capsule (2), provided with a cap (3) which closes the capsule (2) and opens same following pressure thereon. The assembly further comprises a cover (4) connected to the container by means of a threaded coupling in such a way as to close the capsule (2). The cover (4), which interacts following screwing with the capsule (2) is constrained to the container (1) when the capsule (2) is closed, and to the capsule (2) when the capsule (2) is open.

4 Claims, 1 Drawing Sheet

ASSEMBLY FOR KEEPING SUBSTANCES OF A MIXTURE SEPARATE UNTIL USE

TECHNICAL FIELD

The invention relates to an assembly for keeping different substances apart up until the moment of use.

The market has for some time been offering medicinal mixtures which consist of two distinct ingredients, one of which is a powder, the other a liquid. These ingredients have to be kept separate up until the moment of use.

BACKGROUND ART

For the kind of separate packaging mentioned above, the prior art teaches assemblies which include one container for the powder and another for the liquid. These two elements are, at the moment of use, set in communication with one another so that the liquid and powder can mix. One of the assemblies is constituted by a capsule, arranged on the container and provided with a cutting element which by pressure enters the liquid container, which is closed by a thin membrane, cutting the membrane so as to allow the powders to penetrate into the container. In the cases of some medicines, this packaging exhibits a drawback constituted by the permeability of the thin membrane closing off the capsule. Indeed, with some substances a deterioration can be observed in the powders which is undoubtedly caused by the permeability of the container.

A further type of assembly is known, which includes a container for the liquids, on the mouth of which is fixed a capsule made of a deformable substance and containing the powder, which is closed by a cap turned towards the container. The cap, of considerable thickness and thus absolutely liquid-proof, is press-inserted in the capsule with a double purpose. First and foremost, it guarantees the capsule integrity; secondly, it causes a slight: deformation of the end of the capsule which is inserted in the container, which deformation inserts into special understructure niches provided internally of the container mouth, such as to prevent the capsule from being extracted from the container before the cap has been removed from its position.

To remove the cap, and thus to allow the powders to exit from the capsule in the direction of the container, and thus to allow extraction of the capsule from the container so as to use the contents thereof, it is necessary to exert a pressure on the upper part of the capsule; in this way the upper part of the capsule interacts with the cap, pushing it downwards and removing it from its seating. One assembly of this type is described in European Patent no. 634340.

This type of assembly exhibits various problems. Firstly, it means that the assembly has to be made with a special mouth, comprising understructures, which is decidedly awkward and not always easily realisable.

Secondly, it is particularly difficult to achieve a correct coupling between the capsule and the container inasmuch as if this coupling is too loose, the casule can be extracted from the container without the cap being removed, which might lead to tampering with the container contents, obviously not allowable; while if the coupling is too tight, it is particularly difficult to remove the cap from its seating inasmuch as an excess of pressure on the capsule is necessary.

In the latter case, the consumer, at times, carries out this operation in the wrong way (the correct way being by pressing with a finger on the capsule). The consumer thus tips the container over and presses the capsule against a solid surface; in this way, the mixing of the two components of the medicine happens wrongly, because it is not the powder that enters the container but the liquid that enters the capsule, resulting in the formation of lumps and the like, rendering the subsequent emptying of the assembly, lumps and all considerable difficult. To sum up, the two elements making up the medicine are not correctly mixed.

It should be kept in mind that these types of assemblies are made in large number, and using plastic, for which reason it is quite difficult to manufacture using dimensional tolerances which can guarantee a correct and desired connection between capsule and container; indeed, almost always the end result is a too-loose or a too-tight connection.

One aim of the present invention is to obviate the above-mentioned drawbacks, by providing an assembly which is guaranteed liquid-proof, which does not allow the capsule to be removed from the container, if not after the mixing of the two substances, and which does not require considerable effort to carry out the capsule opening operation.

An advantage of the present invention is that it provides an assembly which is constructionally simple and easy to manufacture, and which does not require the use of special-type containers.

DISCLOSURE OF THE INVENTION

These aims and advantages and others besides are all achieved by the assembly of the invention, as it is characterised in the appended claims.

Further characteristics and advantages of the present invention will better emerge from the detailed description that follows, of an embodiment of the inventions, illustrated in the form of a non-limiting example in the accompanying drawings, in which.

Figure 3:
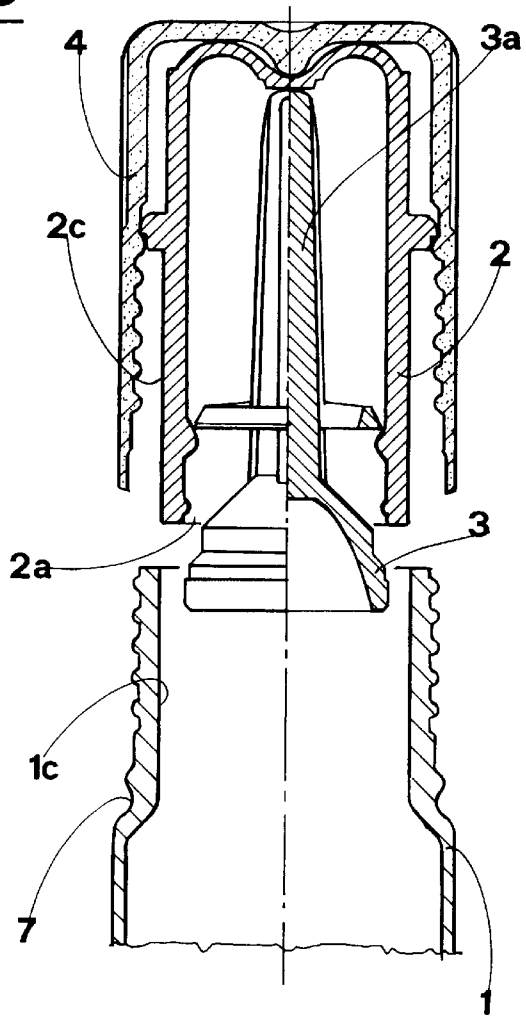
FIG. 3 shows a vertical-elevation section of the mouth of the open container with a capsule-cover assembly detached from the container.

The assembly of the invention comprises a container 1 having a mouth 1*a* on which a capsule 2 is inserted. The container 1 is made of plastic for medical use; the capsule is made of a deformable material, generally an elastically deformable plastic, also for medical use. All of these materials are of known type and in common use. The capsule 2 is internally hollow and is provided with an aperture 2*a* which faces internalwise of the container 1 when the capsule 2 is inserted thereon.

The capsule 2 is further provided with a portion 2*c* of external lateral surface which is cylindrical and which, when the capsule 2 is inserted on the container 1, achieves a slight interference coupling with a portion 1*c* of internal lateral surface of the container 1, which is also cylindrical. The depth of insertion of the capsule 2 in the container 1 is regulated by providing the capsule 2 with an external annular swelling 12 which strikes on the upper edge of the container 1.

The assembly further comprises a cap 3, also made of plastic, which is provided with a rod appendage 3*a*; the cap 3 is inserted into the capsule 2 in such a way as to close it.

When the cap 3 is inserted into the capsule 2, the end of the aforementioned appendage 3*a* is brought into proximity of the upper end of the capsule 2.

The assembly further comprises a cover 4, made of an appropriately stiff plastic, which is connected to the mouth of the container 1 by means of a threaded coupling, and which is arranged on the container 1 in such a way as to close the capsule 2.

A security strip 5 is provided, made in a single piece with the cover 4 and connected to the lower part thereof by means of an easy-break perimeter zone 10. The strip 10 is internally provided with a first annular projection 6 which couples with a first understructure annular cavity 7 made on the external perimeter of the container 1.

A second annular projection 8 is made internally of the cover 4; preferably the annular projection 8 is made at the end of the threaded zone of the cover 4. The annular projection 8 couples with a second understructure annular cavity 9 made on the external perimeter of the cover 4; preferably the annular cavity 9 is made in the external annular swelling 12 provided on the capsule 2.

In the internal part of the upper base surface of the cover 4 a protuberance 11 is made coaxial to the cover 4 itself.

The following is a description of the way in which the above-described capsule is used.

During the packaging procedure, the liquid is inserted into the container 1; the powder is inserted into the capsule 2 which is then closed by means of the cap 3. This closure, due to the nature of the cap, is liquid-proof and tight.

The closed capsule 2 is then inserted on the neck of the container 1; this operation is extremely simple given the nature of "smooth cylindrical surfaces" of the two lateral surfaces, respectively the container 1*c* surface and the capsule 2*c* surface, which come into reciprocal contact. This conformation of the two surfaces makes the construction very simple, and guarantees a perfect seal against any possible exit of liquid from the container.

Subsequently the cover 4 is inserted on the capsule-container assembly thus obtained. This operation is performed in such a way that the first annular projection 6 made on the security strip is forced into the first annular cavity 7 made on the container 1.

Figure 1:
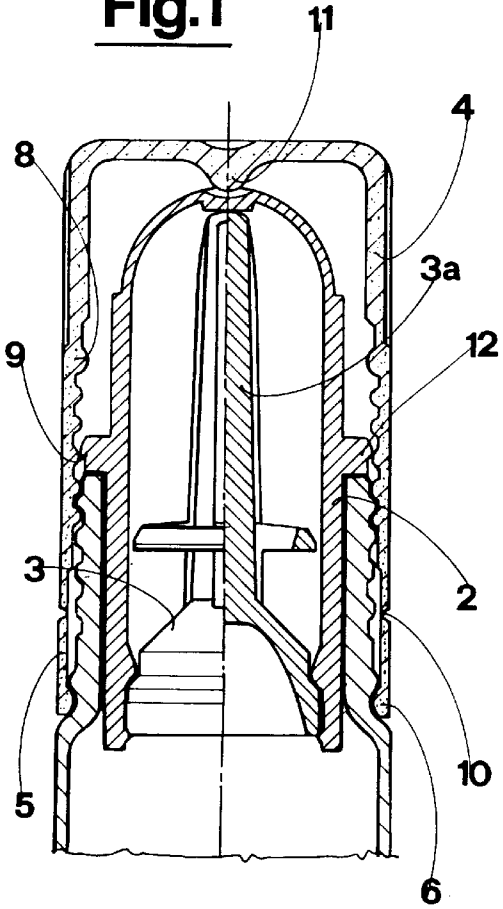
FIG. 1 shows a vertical-elevation section of the mouth of the container on which are inserted: the capsule, with the tap in closed position, and the cover integral, partly screwed to the container (first conformation)

In this first conformation of the assembly, which is illustrated in FIG. 1 and is the conformation in which the assembly is sold over the counter, the cover 4 is solidly anchored to the container 1 and is partially screwed on the container 1 itself. In this configuration the cover 4 performs a first function of preventing fraudulent access to the capsule 2 and thus interference with the capsule 2 or the container 1. At moment of use the security strip 5 is removed so that the cover 4 is constrained to the container 1 only by its threaded coupling; rotating the cover 4 causes an axial translation downwards of the cover 4 itself, which translation causes pressure of the protuberance 11 on the upper part of the capsule 2, which in turn presses against the rod appendage 3*a* of the cap 3, causing the latter to descend and thus open the capsule 2 with a consequent exit of the powders which thus penetrate into the container 1 and mix with the liquid. Like in other capsules, a striker is provided to stop the cap from sliding into the container 1.

The cover 4 can be screwed until the second annular projection 8 inserts into the second annular cavity 9 made on the capsule 2.

The second function of the cover 4 is to make it so that this operation requires only a minimal effort on the part of the user, who, as can be clearly understood, would have no difficulty in carrying out the mixing procedure of the two substances constituting the medicinal mixture, as this requires only the screwing of the cover 4.

Figure 2:
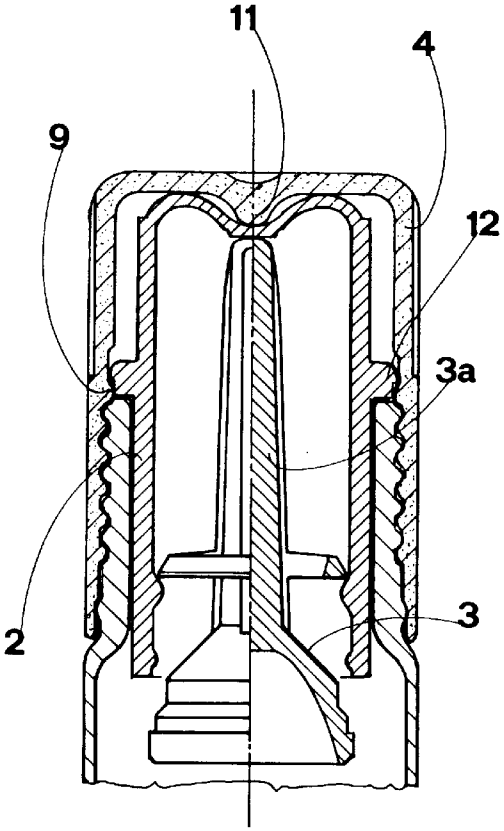
FIG. 2 shows a vertical-elevation section of the mouth of the container on which are inserted: the capsule, with the cap in an open position, and the cover now deprived of its security strip and completely screwed to the container (second conformation)

In the second conformation of the assembly, illustrated in FIG. 2, the cover 4 is solidly anchored to the capsule 2, thanks to the annular projection 8 and the cavity 9, and is not constrained to the container, apart from by the threaded coupling.

It is now possible, and extremely easy, to open the container; it is sufficient to unscrew the cover 4, which, as it translates in axial direction upwards, draws the capsule 2 and the cap attached thereto. Also in this case the smooth coupling surfaces between the capsule 2 and the container 1 render this operation very simple to carry out.

This situation, in which the container is accessible and contains the medicine with the two substances already mixed, is illustrated in FIG. 3.

A pharmaceutical application has been suggested for this assembly, but it could be suitable for other uses, too; for example, in the cosmetics, chemistry, food fields, wherever it becomes necessary to commercialise substances, not necessarily in powder and liquid form as described herein, but all substances which must remain separate until the moment of use.

Modification of a practical-applicational nature could be made to the invention without its foresaking the chosen field of protection. For example, the threaded coupling between the cover 4 and the capsule 2 could be substituted by another type of coupling exhibiting the same characteristic as a threaded coupling, namely that of permitting axial translation of the cover 4 with respect to the capsule and requiring a minimum effort for performing said translation. The security strip could be of the tear-off type or the easy-break type, or any other suitable type. The dimensional rapports and the shapes of the elements composing the assembly could be different to those illustrated herein.

I claim:

1. An assembly for keeping different substances of a mixture separate up until use, comprising: a container (1) provided with a mouth (1*a*) on which mouth (1*a*) a capsule (2) is inserted, which capsule (2) is made of a deformable material and is internally hollow; said capsule (2) being provided with an aperture (2*a*) turned inwardly of the container (1) when the capsule (2) is inserted on the container (1);

a cap (3) provided with an appendage (3*a*) and inserted in the capsule (2) in such a way as to close said capsule (2) in a first conformation of the assembly; a pressure on said capsule (2) causing a deformation thereof which interacts with the appendage (3*a*), whereupon said assembly assumes a second conformation in which the cap (3) leaves the aperture (2*a*) open;

characterized in that it comprises a cover (4) arranged on the container (1) in such a way as to close the capsule (2), and constrained to the mouth (1*a*) of the container (1) by means of a threaded coupling; said cover (4) being able to interact, following a movement in axial direction, with said capsule (2), causing said capsule (2) to deform; means for connecting being provided for fixing the cover (4) either in the first conformation of the assembly, in which said cover (4) is constrained to the container (1) and does not interact with the capsule (2), or in the second conformation of the assembly, in which said cover (4) is constrained to the capsule and interacts there-with.

2. An assembly as in claim 1, characterized in that said means for connecting comprise: an annular security strip (5), connected to a lower part of the cover by means of an easy-break perimetral zone, which strip is internally provided with a first annular projection (6) which couples with a first understructure annular cavity (7) made on an external perimeter of the container (1), in such a way as to fix the cover in the first conformation of the assembly; a second annular projection (8), made internally of the cover, which couples with a second understructure annular cavity (9) made on an external perimeter of the capsule (2), in such a way as to fix the cover (4) in said second conformation of the assembly.

3. An assembly as in claim 1, characterized in that the capsule (2) is provided with a portion **(2*c*) of external lateral surface which is cylindrical and which, on insertion of the capsule (2*c*) in the container (1), achieves a slight interfering couple with a portion (1*c*) of internal lateral surface of the container (1)**, which is also cylindrical.

4. An assembly as in claim 1, characterized in that it comprises a protuberance (11) made internally of the cover (4) and coaxially thereto, which is conformed and arranged in such a way as to press on the upper part of the capsule (2) during interaction between the cover (2) and the capsule (2).

* * * * *